US005997595A

United States Patent [19]

Yokohama et al.

[11] Patent Number: 5,997,595

[45] Date of Patent: Dec. 7, 1999

[54] BURNER AND A FUEL ETC. SUPPLY METHOD

[75] Inventors: Katsuhiko Yokohama; Toshiyuki Takegawa; Yoshinori Koyama; Yoshiki Yamaguchi, all of Nagasaki, Japan

[73] Assignee: Mitsubishi Jukogyo Kabushiki Kaisha, Tokyo, Japan

[21] Appl. No.: 08/721,335

[22] Filed: Sep. 26, 1996

[30] Foreign Application Priority Data

Oct. 3, 1995 [JP] Japan ..... 7-256334
Aug. 7, 1996 [JP] Japan ..... 8-208332

[51] Int. Cl.[6] ..... C10J 3/50

[52] U.S. Cl. ..... 48/86 R; 48/180.1; 48/189.1; 48/189.5; 239/399; 239/405; 239/487; 431/354

[58] Field of Search ..... 48/86 R, 87, DIG. 7, 48/200–203, 206, 210, 180.1, 189.1, 189.5, 213; 239/399, 405, 427.3, 432, 487, 434.5, 417, 419.3; 431/350–351, 182, 185, 354, 284, 278, 217; 110/260, 264, 347

[56] References Cited

U.S. PATENT DOCUMENTS

| | | | |
|---|---|---|---|
| 4,150,631 | 4/1979 | Frey et al. . | |
| 4,250,145 | 2/1981 | Pobst, Jr. et al. | 422/151 |
| 4,364,744 | 12/1982 | Crouch et al. | 48/86 R |
| 4,371,378 | 2/1983 | Brent et al. | 48/86 R |
| 4,400,179 | 8/1983 | Marion et al. | 48/86 R |
| 4,407,205 | 10/1983 | Beaufrere | 110/264 |
| 4,685,882 | 8/1987 | Binaski et al. . | |
| 5,411,393 | 5/1995 | Askin et al. | 431/8 |
| 5,433,596 | 7/1995 | Döbbeling et al. | 431/350 |
| 5,558,515 | 9/1996 | Althaus et al. | 431/284 |
| 5,735,681 | 4/1998 | Cheng | 431/10 |
| 5,765,363 | 6/1998 | Mowill | 60/39.03 |

FOREIGN PATENT DOCUMENTS

| | | |
|---|---|---|
| 41613/78 | 5/1980 | Australia . |
| 62809/80 | 4/1981 | Australia . |
| 10846/83 | 8/1983 | Australia . |
| 57082/86 | 11/1986 | Australia . |
| 0026509 | 4/1981 | European Pat. Off. . |
| 0098043 | 1/1984 | European Pat. Off. . |
| 0437698 | 7/1991 | European Pat. Off. . |
| 182393 | 11/1982 | Japan . |
| 205707 | 9/1986 | Japan . |
| 2 093 979 | 9/1982 | United Kingdom . |

*Primary Examiner*—Virginia Manoharan
*Attorney, Agent, or Firm*—Wenderoth, Lind & Ponack, L.L.P.

[57] ABSTRACT

A burner for an entrained bed gasifier is provided in which a stable ignition is accelerated in the vicinity of a fuel jetting port and a good combustion state is maintained. A fuel (1, 3), such as coal and char etc., and a portion of a gasifying agent (2, 4, 5) are premixed in a burner before they a charged into a gasifier. The burner includes a triple tubular member including an outer tubular portion, an intermediate tubular portion, and an inner tubular portion. A seal gas tube is positioned within the inner tubular portion. At the time when the fuel, such as coal and char etc., and a premixing gas (a portion of the gasifying agent) are charged into the burner, at least any one of the fuel, such as coal and char etc., and the premixing gas is charged in a tangential direction relative to the burner central axis so as to be given a swirling directional velocity component.

13 Claims, 13 Drawing Sheets

$$\text{GAS SOLID RATIO} = \frac{\text{CARRYING GAS AMOUNT} + \text{PREMIXING GAS AMOUNT}}{\text{FUEL FLOW RATE}}$$

BURNER AND A FUEL ETC. SUPPLY METHOD

BACKGROUND OF THE INVENTION

1. Field of the Invention

The present invention relates to a burner for jetting a fuel and a gasifying agent (a gas including at least one of oxygen, hydrogen and steam) into an apparatus for gasifying an organic fuel like coal etc., and to a fuel etc. supply method.

2. Description of the Prior Art

FIG. 15 is a diagrammatic view showing an arrangement of gasifier and ancillary machinery and equipment in the prior art. Coal, crushed at a mill 46 and mixed with $N_2$ gas at a mixer 47, is carried by the $N_2$ gas and charged into a coal burner 011 for a gasifier 41. The coal is reacted with a gasifying agent so as to be gasified, and then is separated of char at a char recovery device 42. The coal is then taken out as a generated gas. The separated char enters a mixer 45 and is returned to a char burner 011 for the gasifier 41 by a carrying gas $N_2$ to be burnt by the gasifying agent.

FIG. 16 is a longitudinal sectional view showing one example of a burner in the prior art which charges a fuel and a gasifying agent into a gasifier. The gasifying agent flows in a central passage 012, formed in the center of an inner tube 032. A mixture of the fuel (pulverized coal) and a carrying $N_2$ flows in an annular sectional passage 013, formed between the inner tube 032 and an outer tube 031. The central passage 012 and annular sectional passage 013 are disposed coaxially. A fuel jet 01, 03 and a gasifying agent jet 02, 04 impinge on each other outside the burner, thereby accelerating the mixing of the fuel and the gasifying agent.

In the burner of the prior art in which the fuel jet and the gasifying agent jet impinge on each other outside the burner, if the oxygen partial pressure of the gasifying agent is low, then the combustion speed of the fuel and char becomes smaller than the jet velocity in the close vicinity of burner. Therefore, the ignition point becomes remote from the jetting port of the burner. In a combustor portion of a coal gasifier, there occur shortcomings, such as a worsening of combustibility due to a remote ignition point, and a solidification of ash melted in the burner portion.

As to carrying by nitrogen, the charging amount of nitrogen into the gasifier is preferably reduced as much as possible for the performance of the gasifier. However, in a coaxial type burner, if the charging amount of nitrogen is reduced, the size of the gap between the annular sectional passages in which the fuel flows is made smaller for geometrical reasons, and then a possibility of blockage arises.

In order to obtain a good ignition of fuel, it is necessary to adjust the flow rate of the fuel, char, and the premixing gas, corresponding to calorific value and reaction speed of the fuel, and to set a most appropriate condition for ignition. Conventionally, if the fuel and char are carried by an inert gas such as nitrogen etc., they are mixed with a gasifying agent in the gasifier (but outside the burner) so that the ignition condition is satisfied. If the oxygen partial pressure in the gasifying agent is low, however, the reaction of the fuel and char at the mixing portion close to the burner jetting port is minimal. Therefore, it is difficult to satisfy a condition for stable ignition.

SUMMARY OF THE INVENTION

It is therefore an object of the present invention to provide an apparatus and a method by which the problems in the prior art are solved and the performance of ignition and combustion is enhanced with accurate, secure and stable functions.

The present invention provides a burner for an entrained bed gasifier comprising a means to premix a fuel and a gasifying agent in the burner. Thereby, a portion of the gasifying agent is premixed upstream of a burner jetting port with the fuel carried by an inert gas, the flow rate of the fuel and the premixing gas can be adjusted to the most suitable condition for ignition, and ignition in the vicinity of the burner is stabilized. Further, the amount of fuel carrying gas in the burner portion is increased by the premixing. Hence, the gap between the annular sectional passages through which the fuel flows can be made larger, and the possibility of blockage is reduced.

The present invention also provides a burner comprising a means to give at least one of the fuel flow or the gasifying agent flow a swirling directional velocity component relative to the burner axial direction, and to charge the fuel and the gasifying agent into the burner. Thereby, at the time of mixing the fuel and the premixing gas, a swirling directional velocity component relative to the burner axial direction is given, and recirculation swirls are generated in the vicinity of the burner jetting port. Because of the recirculation swirls, a high temperature combustion gas is circulated to the ignition portion, and temperature of the ignition portion is elevated so that ignition is accelerated.

The present invention also provides a burner comprising a means to charge the gasifying agent into the burner at a flow velocity of 5 to 100 m/s. Therefore, the flow velocity at which the gasifying agent is charged into the burner is set to 5 to 100 m/s, and burner burning due to particle precipitation or a burner breakage due to abrasion can be prevented.

The present invention provides a burner for an entrained bed gasifier comprising a double tubular member, a gasifying agent inlet disposed on the upstream side of an outer tubular member, and a fuel inlet and a gasifying agent inlet disposed on the upstream side of an inner tubular member. At least one of the fuel inlet and the gasifying agent inlet which are disposed on the upstream side of the inner tubular member opens or discharges, in the tangential direction of a circle around the burner axis in a plane perpendicular to the burner axis. Thereby, the fuel and/or the gasifying agent, supplied from at least one of the fuel inlet and the gasifying agent inlet disposed on the upstream side of the inner tubular member of the double tubular member is given a swirling direction velocity component relative to the burner axial direction, and is charged into the burner. Recirculation swirls are generated by the swirling directional velocity component relative to the burner axial direction in the vicinity of the burner jetting port.

The present invention also provides a burner for an entrained bed gasifier comprising a triple tubular member, a gasifying agent inlet disposed on the upstream side of an outer tubular member, a fuel inlet and a gasifying agent inlet disposed on the upstream side of an intermediate tubular member, and a fuel inlet and a gasifying agent inlet disposed on the upstream side of an inner tubular member. At least one of the fuel inlets and the gasifying agent inlets disposed on the upstream side of the intermediate tubular member and the inner tubular member opens in the tangential direction of a circle around the burner axis in a plane perpendicular to the burner axis. Thereby, the fuel and/or the gasifying agent, supplied from at least any one of the fuel inlets and the gasifying agent inlets disposed on the upstream side of the intermediate tubular member and the inner tubular member of the triple tubular member, is given a swirling directional velocity component relative to the burner axial direction, and is charged into the burner. Recirculation swirls are generated by the swirling directional velocity component relative to the burner axial direction in the vicinity of the a burner jetting port.

The present invention also provides a burner for an entrained bed gasifier comprising a triple tubular member, a gasifying agent inlet disposed on the upstream side of an outer tubular member, a fuel inlet and a gasifying agent inlet disposed on the upstream side of an intermediate tubular member, a fuel inlet and a gasifying agent inlet disposed on the upstream side of an inner tubular member, a starting burner disposed in the center of the inner tubular member, and a seal gas passage disposed on the outer circumference of the starting burner. At least one of the fuel inlets and the gasifying agent inlets disposed on the upstream side of the intermediate tubular member and the inner tubular member opens in the tangential direction of a circle around the burner axis in a plane perpendicular to the burner axis. Thereby, the fuel and/or the gasifying agent, supplied from at least one of the fuel inlets and the gasifying agent inlets disposed on the upstream side of the intermediate tubular member and the inner tubular member of the triple tubular member, is given a swirling directional velocity component relative to the burner axial direction, and is charged into the burner. The fuel and gasifying agent inlets located on the upstream side of each of the intermediate and inner tubular portions allow the fuel and gasifying agent to impinge upon each other at the upstream ends of the inner tubular portion and a first annular gap formed between the intermediate tubular portion and the inner tubular portion. Recirculation swirls are generated by the swirling directional velocity component relative to the burner axial direction in the vicinity of the burner jetting port. A secure starting can be produced by the starting burner disposed in the center of the inner tubular member and having the seal gas passage on its outer circumference.

The present invention also provides a burner having a swirler on the inner surface of the downstream side of the outer tubular member. Thereby, a swirling directional velocity component relative to the burner axial direction is accelerated.

The present invention also provides a burner provided with a flame holding block in the vicinity of the downstream side of the outer tubular member. Thereby, flames are secured and combustibility is enhanced.

The present invention also provides a burner in which a mixing ratio of oxygen in the gasifying agent to fuel is set to 0.19 to 0.46 in weight. Thereby, the ignition distance (distance from the burner jetting port to the ignition point) is shortened and a good combustion state is obtained.

The present invention provides a fuel, etc. supply method in a burner for an entrained bed gasifier in which a fuel and a gasifying agent are premixed in the burner and then jetted into the gasifier. Thereby, a portion of the gasifying agent is premixed upstream of a burner jetting port with the fuel carried by an inert gas, as mentioned above. The flow rate of the fuel and the premixing gas can be adjusted to a most suitable condition for ignition, and ignition in the vicinity of the burner is stabilized. Further, the amount of fuel carrying gas in the burner portion is increased by the premixing. Hence, the gap between the annular sectional passages through which the fuel flows can be made larger, and a possibility of blockage is reduced.

The present invention also provides a fuel, etc. supply method in which at least one of the fuel and the gasifying agent is given a swirling directional velocity component relative to the burner axial direction, and the fuel and the gasifying agent are charged into the burner. Thereby, at the time of mixing of the fuel and the premixing gas, a swirling directional velocity component relative to the burner axial direction is given, and recirculation swirls are generated in the vicinity of a burner jetting port. Because of the recirculation swirls, a high temperature combustion gas is circulated to the ignition portion, and the temperature of the ignition portion is elevated so that ignition is accelerated.

The present invention also provides a fuel, etc. supply method in which the gasifying agent is charged into the burner at a flow velocity of 5 to 100 m/s. Thereby, the flow velocity at which the gasifying agent is charged into the burner is set to 5 to 100 m/s, and a burner burning due to particle precipitation or a burner breakage due to abrasion can be prevented.

DESCRIPTION OF THE PREFERRED EMBODIMENTS

Figure 1:
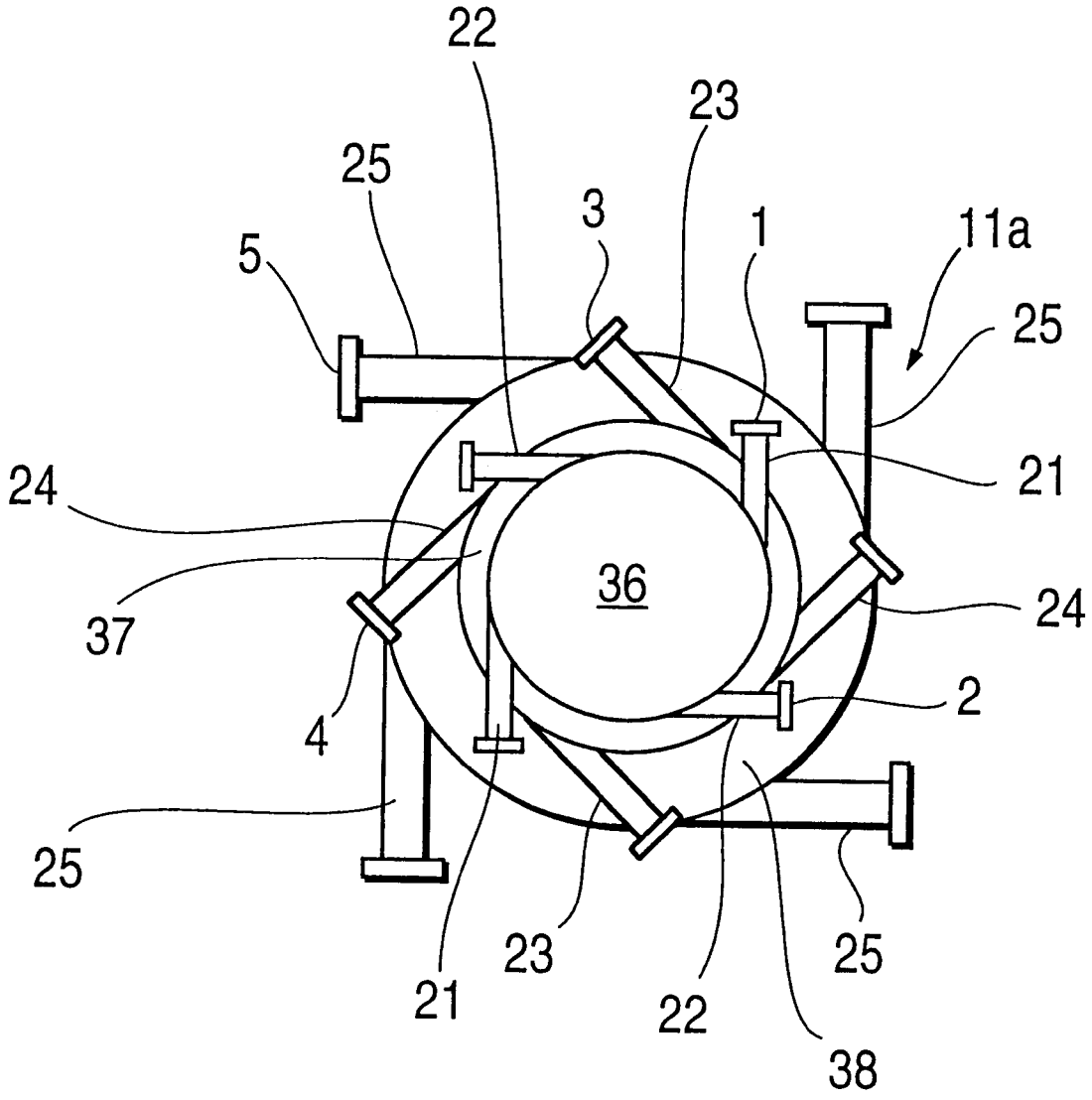
FIG. 1 is a rear view showing a burner of a first preferred embodiment according to the present invention.
Figure 2:
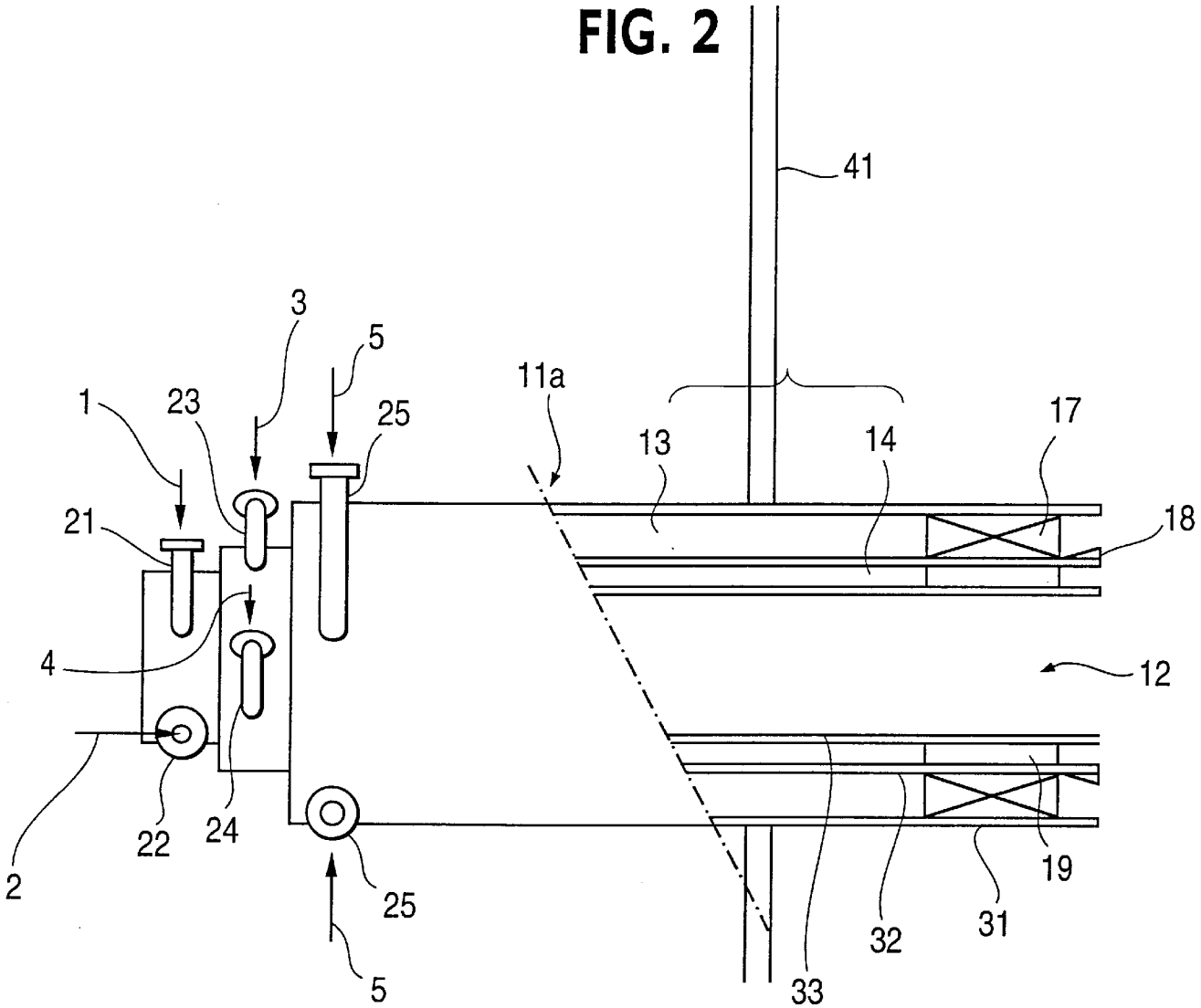
FIG. 2 is a side view, partially sectional, showing the burner of FIG. 1.

A first preferred embodiment according to the present invention is described with reference to FIGS. 1 to 7. Reference number 11*a* designates a burner, which comprises a triple tubular member, in which an inner tube 33, an intermediate tube 32 and an outer casing 31 are disposed coaxially. As shown in the Figures, the tubes are axially coterminous at the downstream end of the triple tubular member, and have a jetting port at the downstream end portion. On the upstream side of the inner tube 33, a fuel and carrying gas inlet 21 and a premixing gasifying agent inlet 22 are disposed, each in a pair with a deviation of 180°, in the tangential direction on the circumferential surface of the inner tube 33. Char and carrying gas ($N_2$) 1 through the fuel and carrying gas inlet 21 and a gasifying agent 2 through the premixing gasifying agent inlet 22 are charged into a central passage 12 in a swirling direction and impinge upon each other at the upstream end.

On the upstream side of the intermediate tube 32, a fuel and carrying gas inlet 23 and a premixing gasifying agent inlet 24 are disposed, each in a pair with deviation of 180°, in the tangential direction on the circumferential surface of the intermediate tube 32. Coal and carrying gas ($N_2$) 3 through the fuel and carrying gas inlet 23 and a gasifying agent 4 through the premixing gasifying agent inlet 24 are charged into an annular sectional passage 14 in a swirling direction and impinge upon each other at the upstream end.

Further, on the upstream side of the outer casing 31, a gasifying agent inlet 25 is disposed, in four units with deviation of 90° each, in the tangential direction on the circumferential surface of the outer casing 31. A gasifying agent 5 is charged into an annular sectional passage 13 in a swirling direction.

Numerals 36, 37, and 38 designate back plates. The back plates 36, 37, and 38 plug the end portion of the inner tube 33, the intermediate tube 32 and the outer casing 31, respectively. At the other end portion of the annular sectional passage 13 defined by the intermediate tube 31 and the outer casing 31, a swirler 17 and a flame holding block 18 are disposed. Numeral 41 designates a portion of a gasifier in which the burner 11*a* is installed.

In the preferred embodiment as so constructed, the char and carrying gas ($N_2$) 1 and the gasifying agent 2, respectively, are charged into the central passage 12 in the tangential direction (the swirling direction) of the inner tube 33 (see FIG. 1).

On the outer side of said central passage 12, the coal and carrying gas ($N_2$) 3 and the gasifying agent 4, respectively, are charged into the annular sectional passage 14 in the tangential direction (the swirling direction) of the intermediate tube 32.

Here, the length from the charging point of the coal, char and gasifying agent to the burner jetting port is set to at least a distance of 5 to 10 times the inner diameter of the central passage 12 or the width of the annular gap between the two circular tubes composing the annular sectional passage 14. This is an appropriate distance for the coal, char and gasifying agent to be sufficiently mixed as they move to the burner jetting port.

The size of the gap is preferably set to 10 times or more of the maximum fuel particle size to avoid a blockage due to particles being carried. In the outermost annular sectional passage 13, a gasifying agent in the necessary total gasifying agent amount minus the gasifying agent amount used for premixing is charged in a swirling direction.

Figure 3:
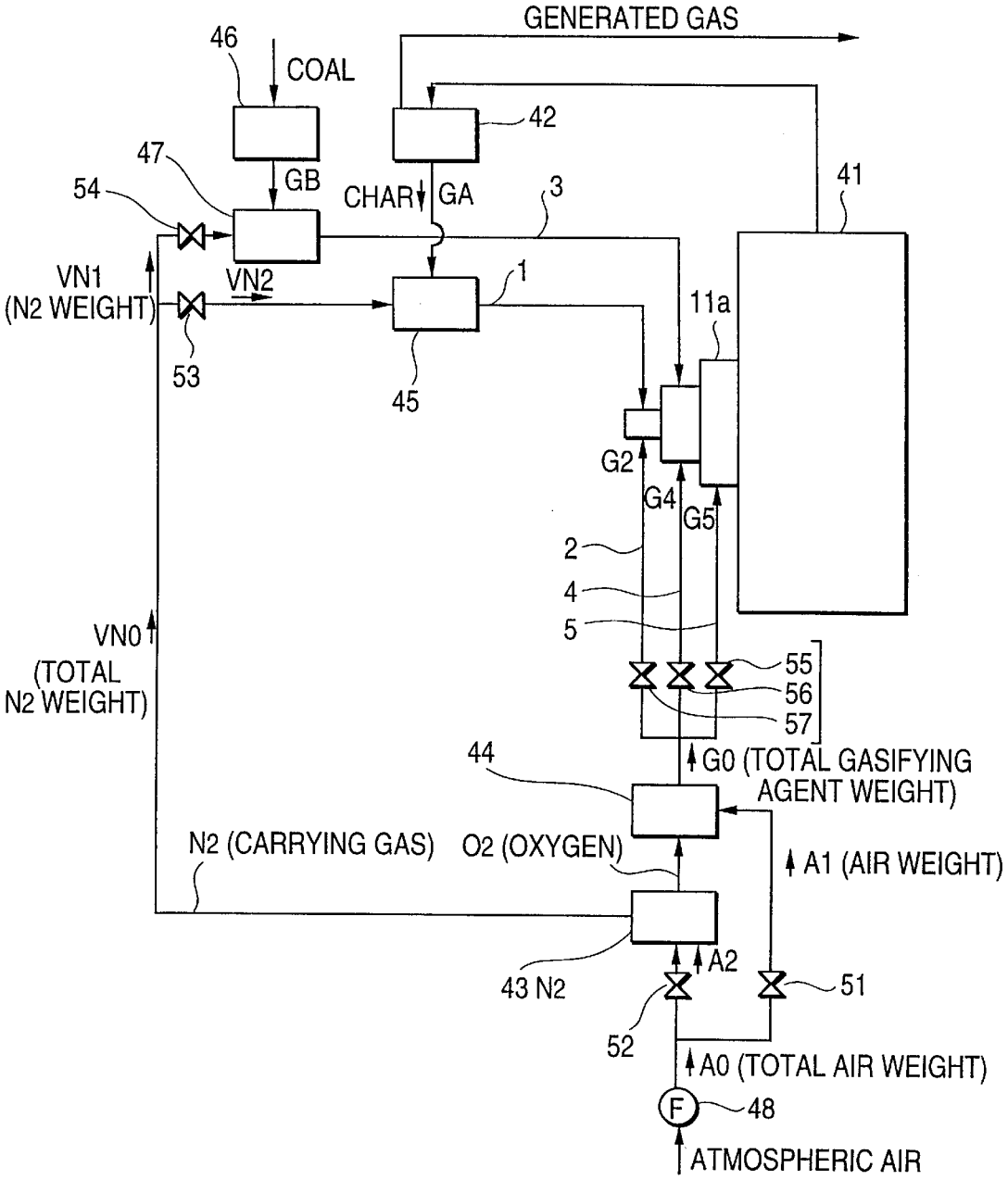
FIG. 3 is a diagrammatic view of a fuel, etc. supply system in a gasifier incorporating the burner of FIG. 1.

FIG. 3 shows the flow of the char and carrying gas ($N_2$) 1, gasifying agent 2, coal and carrying gas ($N_2$) 3, gasifying agent 4 and gasifying agent 5, as they move to the burner 11*a*. The char, gasified at the gasifier 41 and separated from the generated gas at a char recovery apparatus 42, is mixed at a mixer 45 with a carrying gas ($N_2$) supplied through a carrying gas regulating valve 53 and is supplied to said burner 11*a* as the char and carrying gas ($N_2$) 1. Atmospheric air is supplied from a fan 48 via an air regulating valve 52 to a nitrogen separator 43 to be separated to $N_2$, which is used as a carrying gas, and $O_2$. The separated $O_2$ is mixed at a gasifying agent mixer 44 with air supplied which bypasses the nitrogen separator 43 via an air regulating valve 51. This mixture becomes gasifying agent 2 and is supplied to the burner 11*a* via a gasifying agent regulating valve 57.

The coal is pulverized at a mill 46, and is then mixed at a mixer 47 with a carrying gas ($N_2$) supplied through a carrying gas regulating valve 54. It is then supplied to the burner 11*a* as a coal and carrying gas ($N_2$) 3.

A gasifying agent 4, corresponding to the coal and carrying gas ($N_2$) 3, is generated with the gasifying agent 2 at the gasifying agent mixer 44 and is supplied to the burner 11*a* via a gasifying agent regulating valve 56. A gasifying agent 5 to be supplied to the burner 11*a* is separated from the other gasifying agent 2, 4 at the outlet of the gasifying agent mixer 44 and is supplied to the burner 11*a* via a gasifying agent regulating valve 55.

Accordingly, the total weight GO of the gasifying agent composed of the air (weight A1) via the air regulating valve 51 and the oxygen component $O_2$ from the nitrogen separator 43 is the sum of the gasifying agent weight G2, G4 and G5 of the gasifying agent 2, 4 and 5, respectively. The total weight VN0 of the carrying gas ($N_2$) is the sum of the weight VN1 of the carrying gas ($N_2$) supplied via the carrying gas regulating valve 54 to carry coal and the weight VN2 of the carrying gas ($N_2$) supplied via the carrying gas regulating valve 53 to carry char.

Figure 5A:
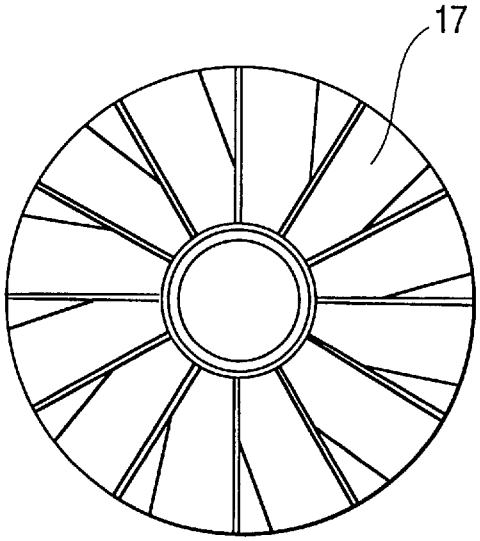
FIG. 5 shows a swirler disposed at the inner end portion of the burner of FIG. 2, wherein FIG. 5(*a*) is a front view and FIG. 5(*b*) is a longitudinal sectional view.
Figure 5B:
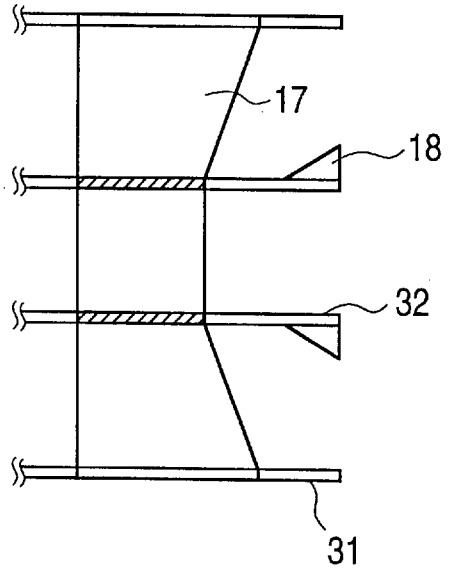

The swirler 17 used in this preferred embodiment is shown in FIG. 5. FIG. 5(*a*) is a front view thereof and FIG. 5(*b*) is a longitudinal sectional view thereof. By use of such construction, the swirler 17 is able to mix air and coal uniformly. Therefore, not only ignitability but also combustion are improved.

Figure 6:
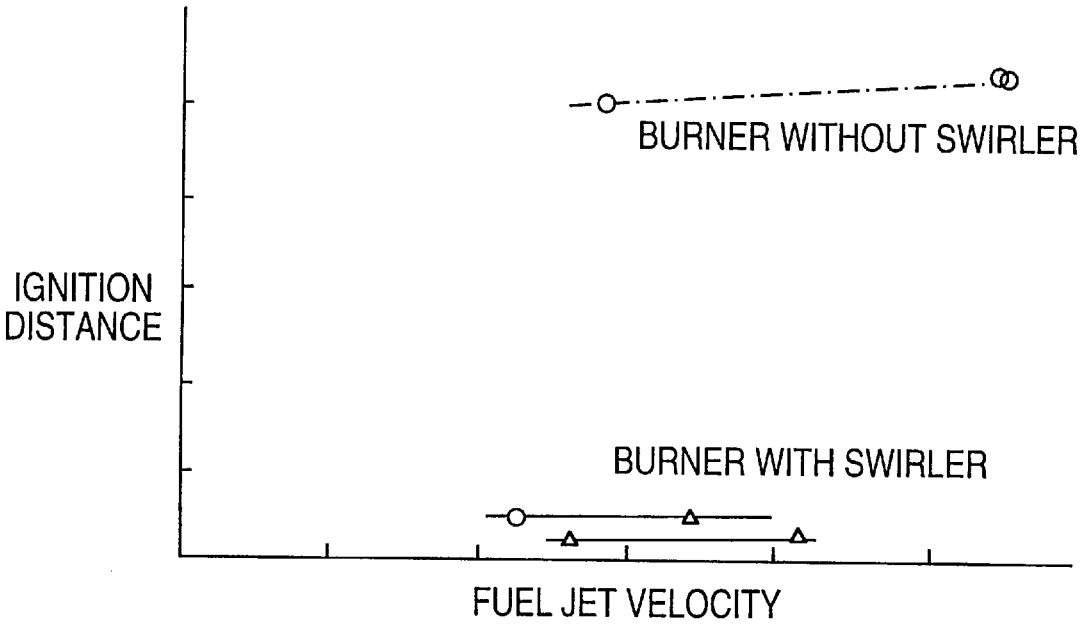
FIG. 6 is a graph showing the relation between a fuel jet velocity and an ignition distance.

FIG. 6 is a graph showing the relation between fuel jet velocity and ignition distance. It is found that in the range of fuel jet velocity of 5 to 100 m/s, the ignition distance is shortened to approximately 1/10 by using a swirler, and a good ignition state is obtained.

Figure 7:
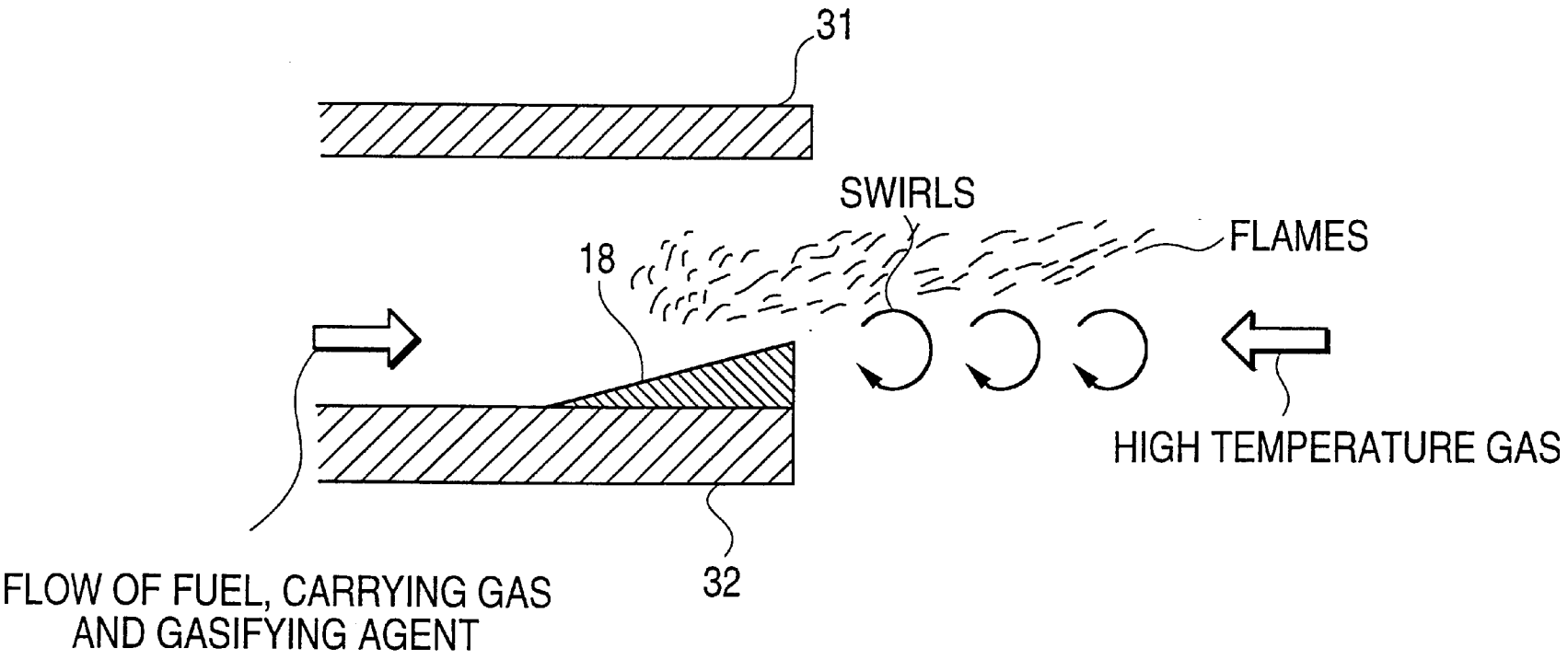
FIG. 7 is an explanatory view showing functions of a flame holding block disposed at the inner end portion of the burner of FIG. 2.

In one embodiment, a flame holding block 18 may be provided at a respective jetting port of the annular sectional passages. This block 18 is fitted within the flow, as shown in FIG. 7, and generates swirls downstream thereof to recirculate a high temperature gas. Thereby, ignition is accelerated.

In this preferred embodiment, the charging velocity of the premixing gas is adjusted to a range of 5 to 100 m/s. If the charging velocity is less than 5 m/s, there is a possibility of burning the burner due to precipitation of particles. If it is more than 100 m/s, the burner is damaged due to abrasion. Hence, the most preferable range is 5 to 100 m/s as mentioned above.

Figure 4:
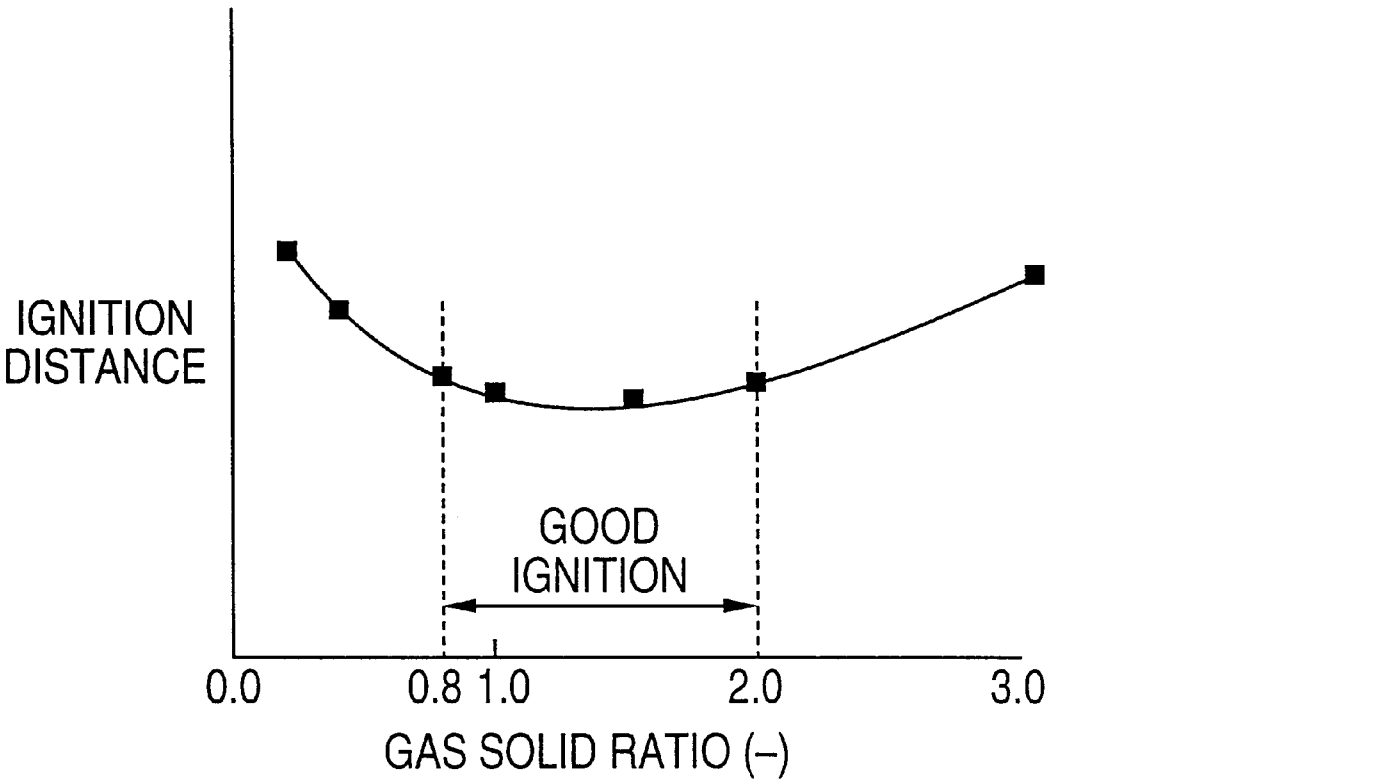
FIG. 4 is a graph showing the relation between a mixing ratio of premixing gas and fuel and an ignition distance (distance from a burner jetting port to an ignition point).

Further, in this preferred embodiment, the mixing ratio of the premixing gas to the fuel is set to a range of 0.8 to 2.0. This ratio corresponds to 0.19 to 0.46 in the ratio of oxygen in the gasifying agent to the fuel, with the oxygen component in the air being 0.232 weight percent. As shown in FIG. 4, when the mixing ratio of the premixing gas to the fuel is in that range, the ignition distance (distance from the burner jetting port to the ignition point) is short, and a good combustion state can be obtained. As for the entire gasifying agent, the premixing gas is mixed with coal or char in a range of 0 to 50%, preferably 10 to 30%, of the entire gasifying agent. It can be mixed into coal and char, or either of them only, at an appropriate proportion.

As understood from the above explanation, the gasifying agent 2, 4 and 5 in this preferred embodiment is an oxygen rich air. While the inner tube 33, the intermediate tube 32, and the outer casing 31 into which the gasifying agent is supplied are shown as disposed coaxially and being of circular sectional shapes, they are not limited thereto but may be of an oval sectional or square sectional shape, although a circular sectional shape is preferable.

The number and the fitting position of each inlet of the gasifying agent or the carrying gas etc. are shown as fitted to be open in the tangential direction to the inner tube 33, the intermediate tube 32 and the outer casing 31, respectively. However, they are not limited to those described above but may naturally be selected freely corresponding to the size of the apparatus, etc.

Further, each inlet of the gasifying agent or the carrying gas etc. of the inner tube 33, the intermediate tube 32, and the outer casing 31 is shown to be fitted so as to generate swirl flows all in the same direction. However, the direction of the swirl flow can be decided arbitrarily for each of the tubes.

Furthermore, at each of the inner tube 33, the intermediate tube 32 and the outer casing 31, the respective inlet of the gasifying agent or the carrying gas etc. is open in the tangential direction on the same circumferential surface. However, it is not limited thereto, but may include some inlets being open in the direction of the normal line.

Figure 8:
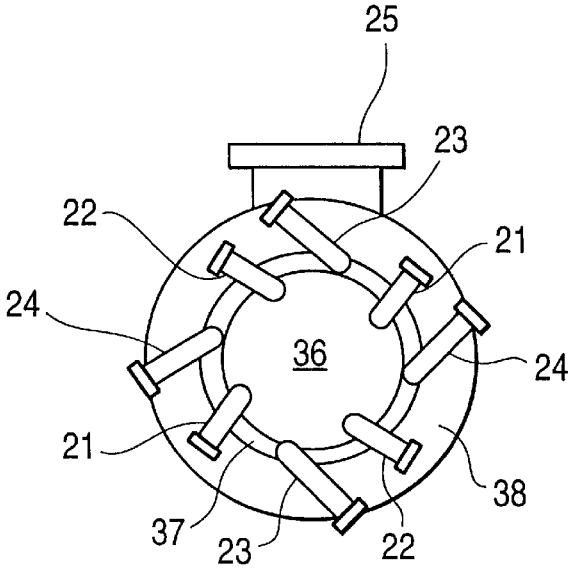
FIG. 8 is a rear view showing a burner of a second preferred embodiment according to the present invention.

A second preferred embodiment according to the present invention is described with reference to FIGS. 8 and 9. In this preferred embodiment, each inlet of the gasifying agent or the carrying gas etc. is fitted on the circumferential surface of the inner tube 33, the intermediate tube 32 and the outer casing 31, respectively, as in the first preferred embodiment. However, in this embodiment the inlet of the inner tube 33 and the intermediate tube 32, respectively, is fitted on each corresponding back plate 36 and 37. Other construction, function, etc. is substantially the same as those of the first preferred embodiment. Therefore, common portions in the figure are given the same numerals and repetition of the description is omitted.

In this preferred embodiment, the fuel (char) and carrying gas inlet 21 and the premixing gasifying agent inlet 22 are fitted on the back plate 36, each in a pair, in opposing relation to each other around the axial center. The fuel (coal) and carrying gas inlet 23 and the premixing gasifying agent inlet 24 are likewise fitted on the back plate 37, each in a pair, in opposing relation to each other around the axial center. One gasifying agent inlet 25 is fitted on the outer casing 31 with an opening directed in its axial direction.

Figure 9:
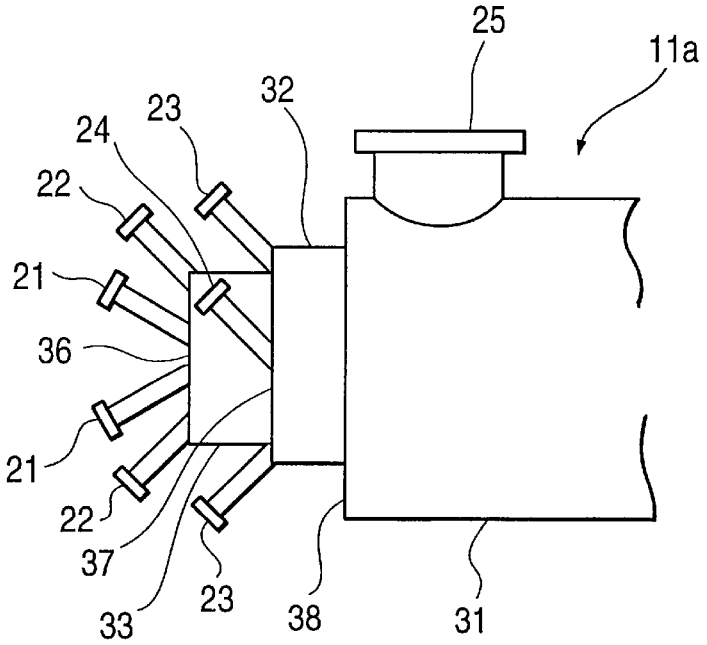
FIG. 9 is a side view showing the burner of FIG. 8 with its tip end side being omitted.

Each inlet fitted on the back plates 36, 37 does not open in a plane perpendicular to the axial center, but opens in a plane crossing that plane, as shown in FIG. 9. The inlets also open in the tangential direction of a circle around the axial center, as seen in a projected plane perpendicular to the axial center (FIG. 8).

In this preferred embodiment, the openings are directed in the tangential direction in a circle around the axial center on the projected plane as mentioned above so that swirl flows are generated within the inner tube 33 and the intermediate tube 32. However, all the openings are not necessarily directed in the tangential direction so that swirl flows are generated, because a swirler 17 is provided at the inner end portion of the annular sectional passage 13, although not shown in the figure.

As for the inlets for generating swirl flows, the necessity is to generate swirl flows; the direction of the openings can be selected variously.

Figure 10:
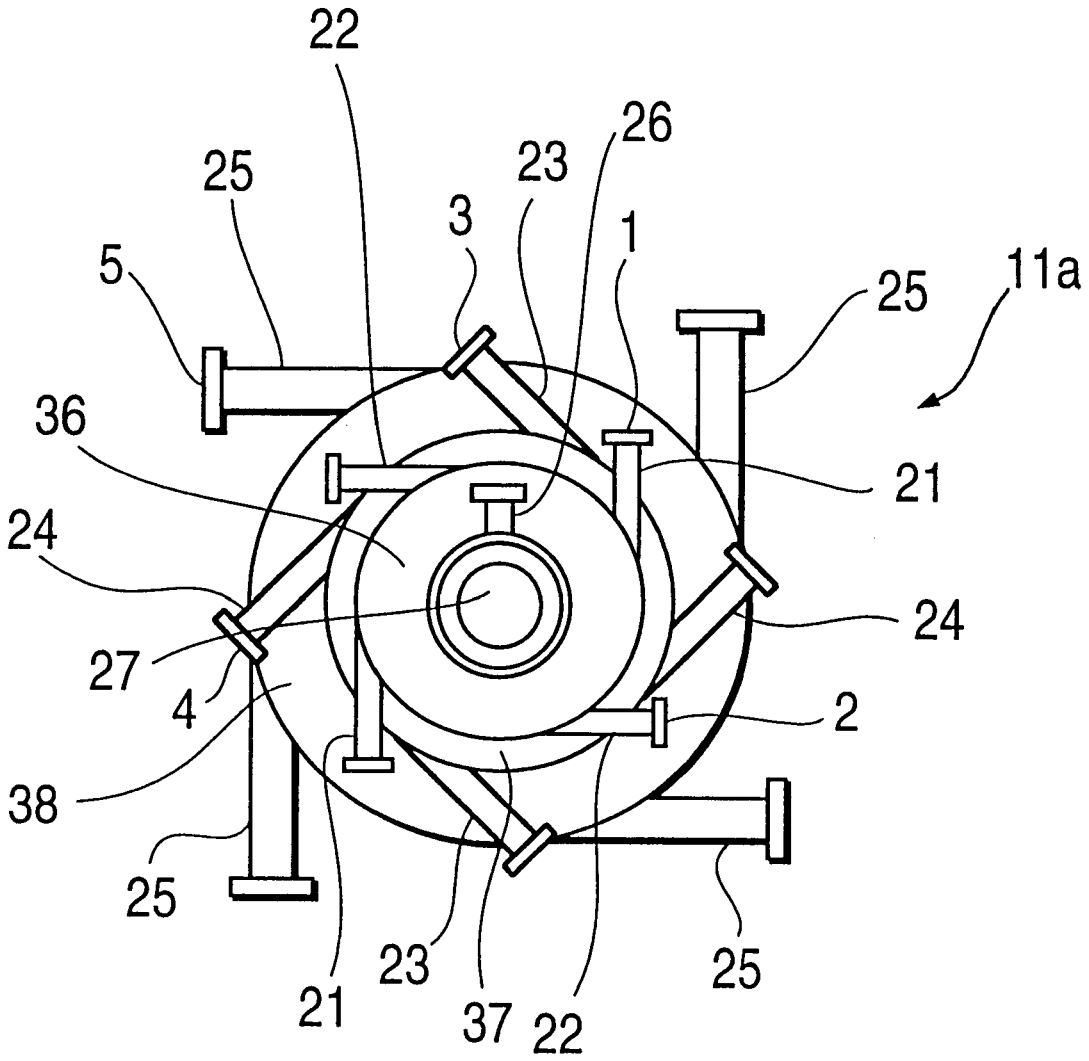
FIG. 10 is a rear view showing a burner of a third preferred embodiment according to the present invention.
Figure 11:
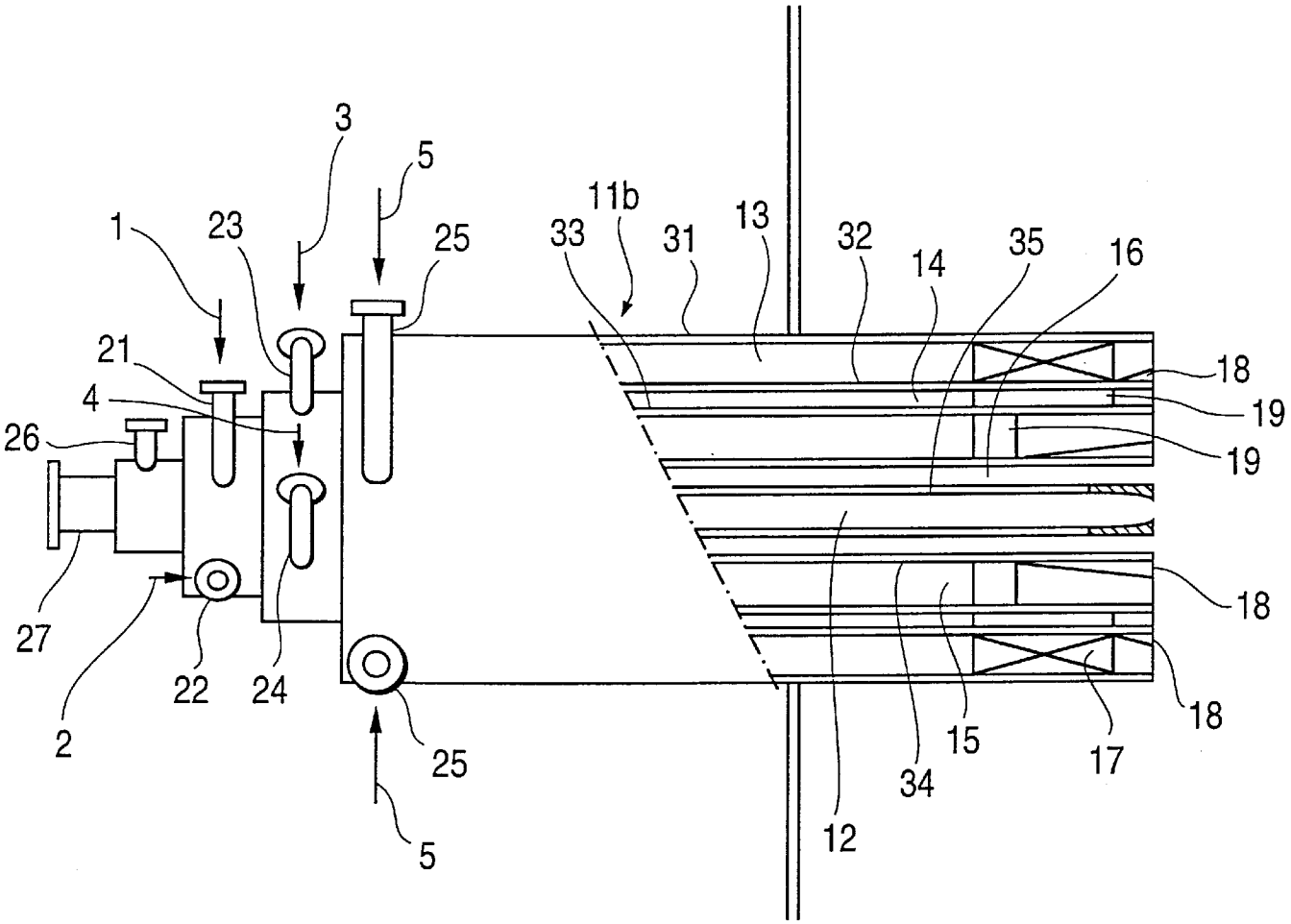
FIG. 11 is a side view, partially sectional, showing the burner of FIG. 10.

A third preferred embodiment according to the present invention is described with reference to FIGS. 10 and 11. In this preferred embodiment, as compared with the first preferred embodiment, the description is the same except that a starting burner is incorporated. As shown in FIG. 11, the tubes are axially coterminous at the downstream end of the triple tubular member. Hence, common portions are given the same numerals in the figure, and different points are described with a repeated description being omitted as much as possible.

In this preferred embodiment, a starting burner inner tube 35 is provided in the center of the inner tube 33. A seal gas inner tube 34 is provided on the outer portion of the starting burner inner tube. A seal gas inlet 26 and a starting fuel inlet 27 are provided at the outer end of the burner 11*b*.

In this preferred embodiment, therefore, construction is made by a quadruple circular tube if the starting burner inner tube 35 is included, and by a quintuple circular tube if the seal gas inner tube 34 is included. When starting the gasifier, a starting fuel is supplied from the starting fuel inlet 27 and the starting burner inner tube 35 is started.

Thereafter, upon a steady operation state being obtained, work of the starting burner inner tube 35 is stopped and a seal gas is supplied from the seal gas inlet 25 within the seal gas inner tube 34. Thereby, heat transfer between the starting burner inner tube 35 and the inner tube 33 is intercepted.

Reaction moves from the char and carrying gas ($N_2$) 1 and the corresponding gasifying agent 2 charged into the central passage 12 in the swirling direction (so as to impinge upon each other at an upstream end thereof) to the coal and carrying gas ($N_2$) 3 and the corresponding gasifying agent 4 charged into the annular sectional passage 14 of the outer side of said central passage 12 in the swirling direction (so as to impinge upon each other at an upstream end thereof). The reaction moves further to the gasifying agent 5 etc. which flows within the annular sectional passage 13 of the further outer side thereof.

Here also, as in the first preferred embodiment, the length from the charging point of the coal, char and premixing gas to the burner jetting port is set to at least a distance of 5 to 10 times the gap between the two circular tubes composing the annular passage. Also, the size of the gap is preferably set to at least 10 times the maximum particle size of the carried fuel particles, as in the first preferred embodiment.

A gasifying agent 5 in the amount of the necessary total gasifying agent amount minus the gasifying agent amount used for premixing is charged into annular sectional passage 13 in the swirling direction. As mentioned above, a swirler 17, which makes swirl flows of gas in the same direction as that at the charging point, may be provided at the jetting port of the annular sectional passage 13. A flame holding block 18 may also be provided at the jetting port of the respective annular sectional passage 13, 14.

Figure 12:
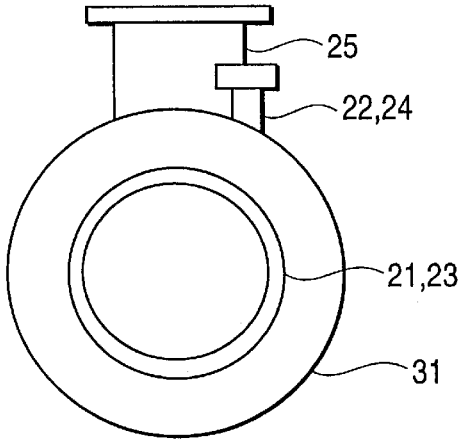
FIG. 12 is a rear view showing a burner of a fourth preferred embodiment according to the present invention.
Figure 13:
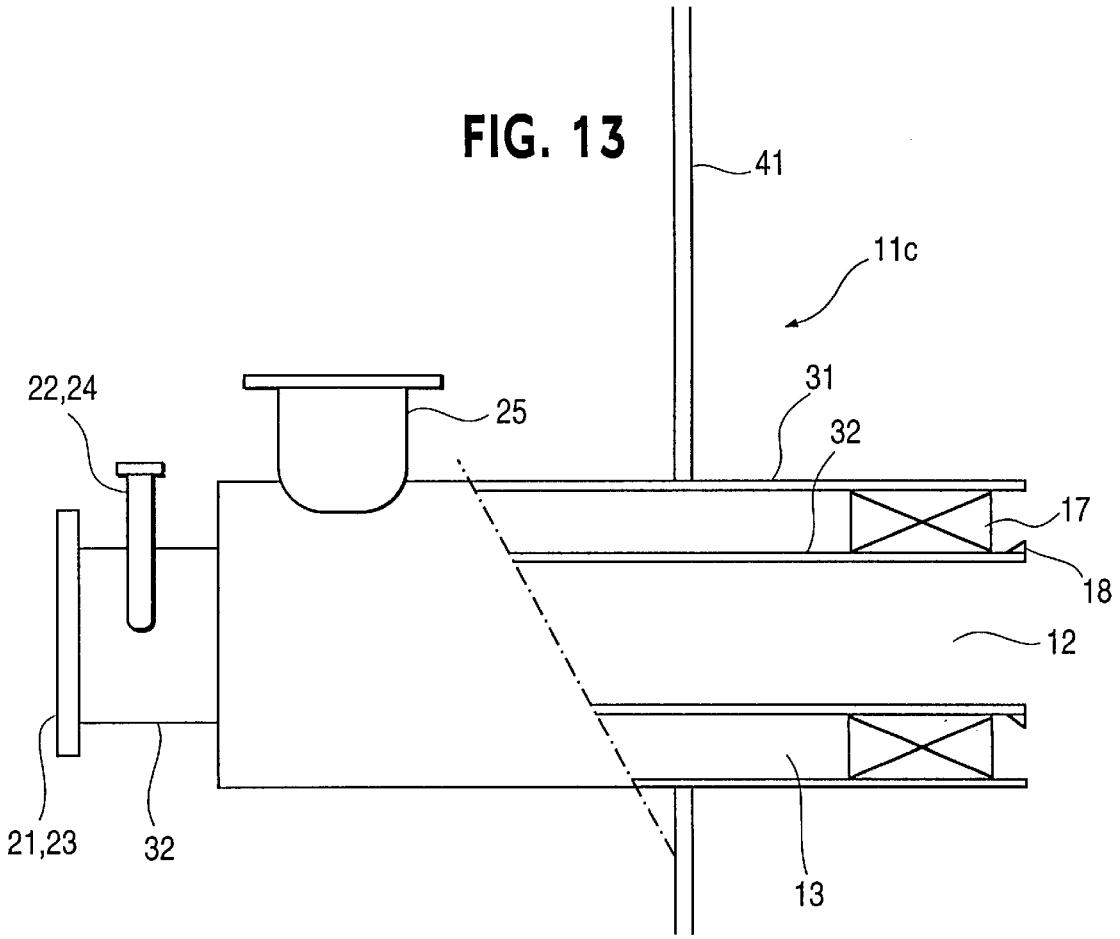
FIG. 13 is a side view, partially sectional, showing the burner of FIG. 12.

A fourth preferred embodiment according to the present invention is described with reference to FIGS. 12 to 14. This preferred embodiment can be said to be a prototype summarizing the above-mentioned first to third preferred embodiments. Common portions are shown with the same numerals in the figures, and different points are described with any repeated description being omitted.

In this preferred embodiment, the inner tube 33 and the intermediate tube 32 in the first to third preferred embodiments are combined in one inner tube 32. The fuel (char) and carrying gas inlet 21 and the fuel (coal) and carrying gas inlet 23, being made as one, are connected to the inner tube 32 so that the char and carrying gas ($N_2$) 1 and the coal and carrying gas ($N_2$) 3 are supplied in the axial direction. The premixing gasifying agent inlets 22 and 24 are also made as one, and are open on the circumferential surface in the tangential direction so that swirling flows, mainly made of the gasifying agents 2 and 4, are generated.

According to this preferred embodiment as so constructed, in the inner tube 32, the char and carrying gas ($N_2$) 1 the coal and carrying gas ($N_2$) 3, the gasifying agent 2, and the gasifying agent 4 are mixed together. These are further mixed with the gasifying agent 5 flowing out of the outer casing 31 via the swirler 17, and a reaction occurs at the outlet of the burner 11*c*. A flame holding block 18 may be disposed at the jetting port of the inner end portion of the inner tube 32.

Figure 14:
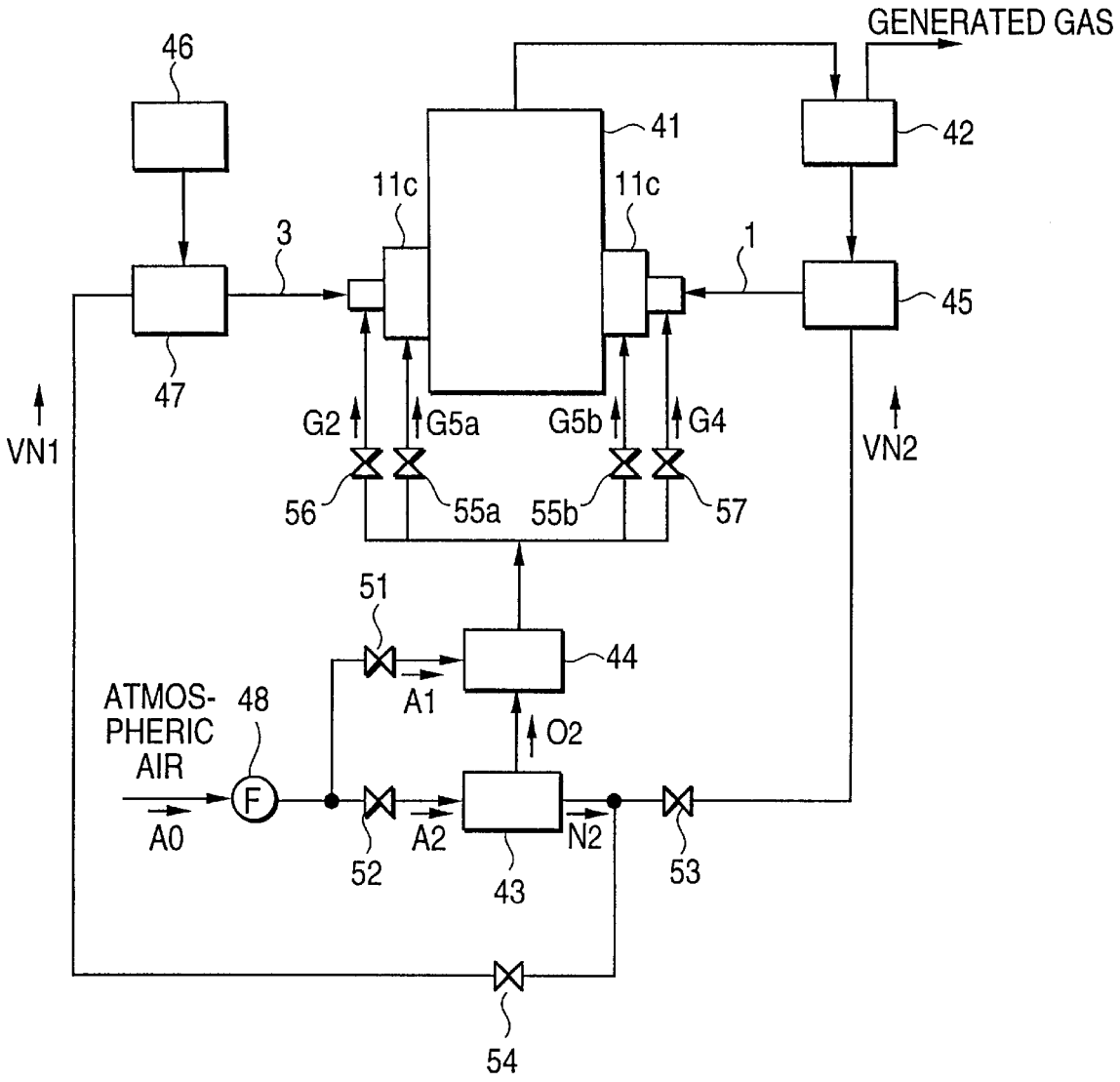
FIG. 14 is a diagrammatic view of a fuel etc. supply system in a gasifier incorporating the burner of FIG. 12.
Figure 15:
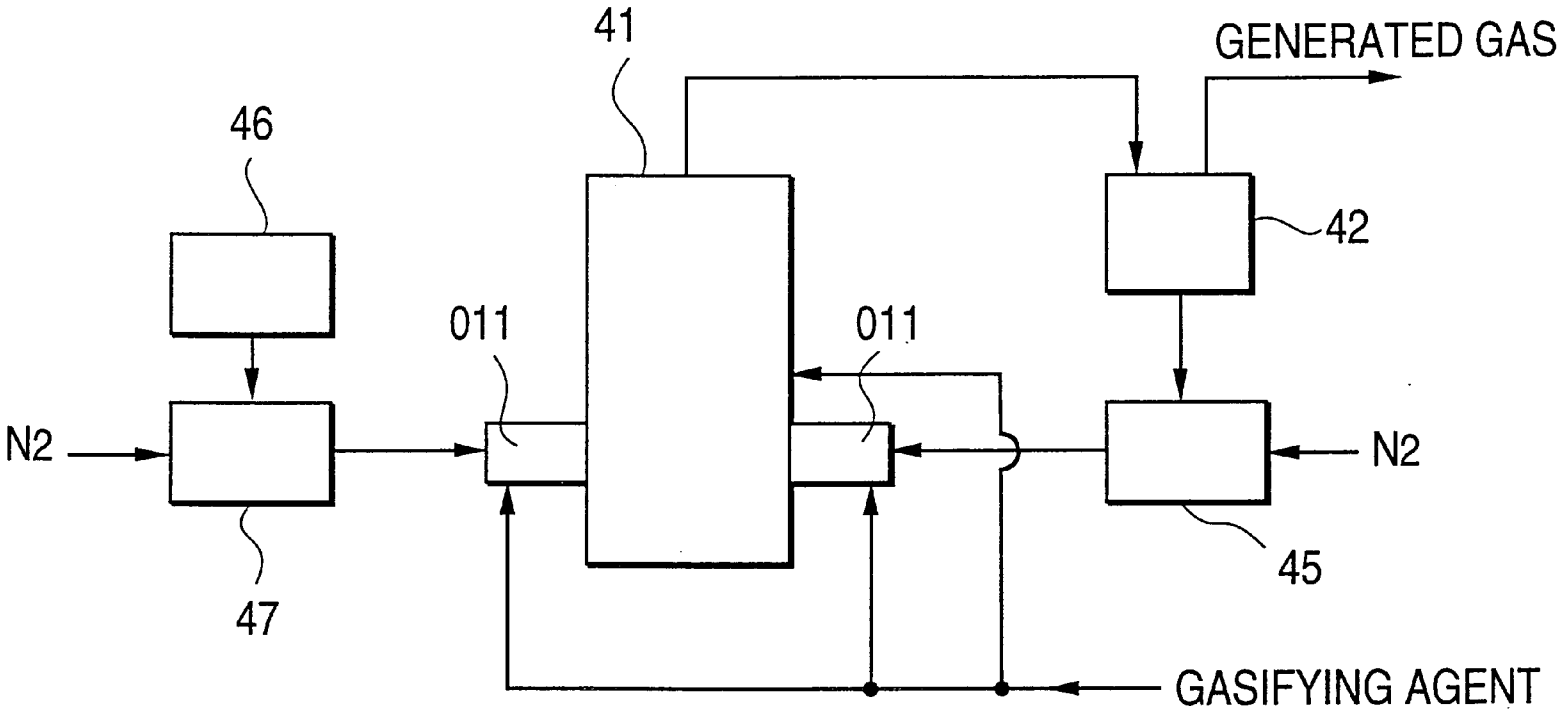
FIG. 15 (PRIOR ART)
FIG. 15 is a diagrammatic view showing an arrangement of gasifier and ancillary machinery and equipment in the prior art.
Figure 16:
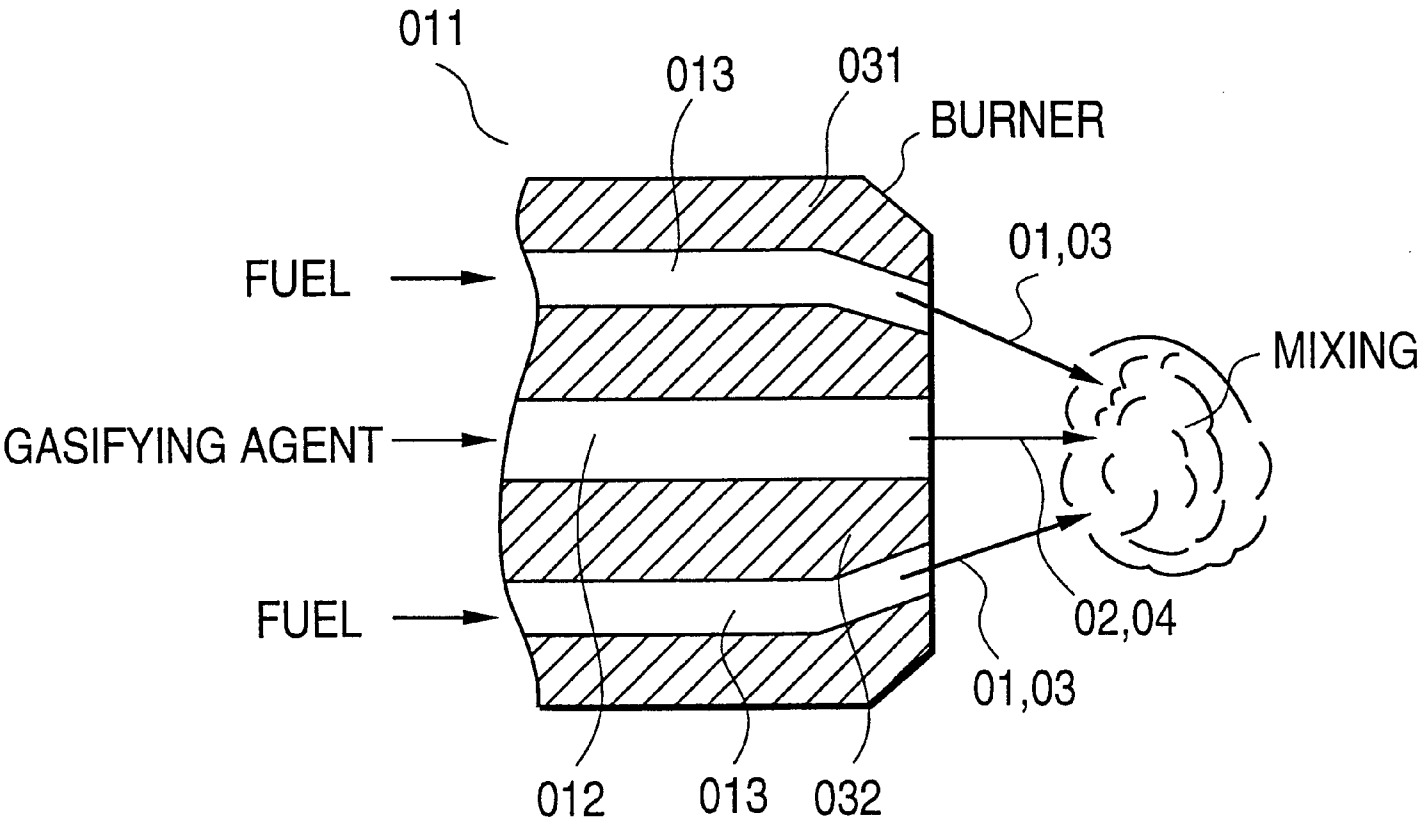
FIG. 16 (PRIOR ART)
FIG. 16 is a longitudinal sectional view showing one example of a burner in the prior art.

FIG. 14 shows the flows of the char and carrying gas ($N_2$) 1, gasifying agent 2, coal and carrying gas ($N_2$) 3, gasifying agent 4 and gasifying agent 5, moving to the burner 11*c*. In FIG. 14, although two burners 11*c* are seen oppositely on the left and the right side of the gasifier 41 in the central portion, this is only to emphasize a unified form. In this form, as described with respect to FIGS. 12 and 13, the char and carrying gas ($N_2$) 1 and the gasifying agent 2 are gathered in one tube, and the coal and carrying gas ($N_2$) 3 and the gasifying agent 4, also gathered in one tube, are mixed therewith while swirling. There is in fact no plural burners 11*c*.

Other portions are substantially the same as those shown in FIG. 3 for the first preferred embodiment. The same portions are shown with the same numerals in the figures, with a description being omitted.

The present invention has been described by using preferred embodiments shown in the figures, but the present invention is not limited thereto. Various changes and modifications in the definite construction may be added within the scope of the present invention.

According to the present invention, in a burner for an entrained bed gasifier, a stable ignition in the vicinity of a fuel jetting port is accelerated, a good combustion is maintained, and a blockage and burning or abrasion of the burner can be suppressed.

According to the present invention, at the time of mixing of the fuel and the premixing gas, a swirling directional velocity component relative to the burner axial direction is given. Recirculation swirls are generated in the vicinity of a burner jetting port. Thereby, a high temperature combustion gas is circulated to the ignition portion, temperature of the ignition portion is elevated, and ignition is accelerated.

According to the present invention, an appropriate flow velocity at which the gasifying agent is charged into the burner is selected. Therefore, a burner burning due to particle precipitation or burner breakage due to abrasion can be prevented.

According to the present invention, a preferable swirling directional velocity component relative to the burner axial direction is obtained and preferable recirculation swirls are generated in the vicinity of the burner jetting port.

According to the present invention, by using a construction of a triple tubular member, a preferable swirling directional velocity component relative to the burner axial direction is obtained. Preferable recirculation swirls are also generated in the vicinity of the burner jetting port.

According to the present invention, by using a construction of a triple tubular member and a centrally disposed starting burner, a secure starting is obtained by the starting burner. Also, a preferable swirling directional velocity component relative to the burner axial direction is obtained and preferable recirculation swirls are generated in the close vicinity of the burner jetting port.

According to the present invention, by using a swirler, a swirling directional velocity component relative to the burner axial direction can be accelerated.

According to the present invention, by using a flame holding block, flames are secured and combustibility can be enhanced.

According to the present invention, an appropriate mixing ratio of oxygen in the gasifying agent and fuel is selected, the ignition distance is shortened, and a good combustion state can be realized.

According to the present invention, a stable ignition in the close vicinity of the fuel jetting port is accelerated, a good combustion state is maintained, and a method to suppress a burner blockage, burning or abrasion can be obtained.

According to the present invention, when the fuel and the premixing gas are mixed, a swirling directional velocity component relative to the burner axial direction is given. Also, a high temperature combustion gas is circulated to the ignition portion, the temperature of the ignition portion is elevated, and a useful method to accelerate ignition can be obtained.

Finally, according to the present invention, a preferable swirling directional velocity component relative to the burner axial direction is obtained. Preferable recirculation swirls are also generated in the close vicinity of the burner jetting port.

What is claimed is:

1. A burner comprising:

a triple tubular member including an outer tubular portion having an upstream end and a downstream end, an intermediate tubular portion having an upstream end and a downstream end, and an inner tubular portion having an upstream end and a downstream end;

wherein said triple tubular member has a central axis;

wherein a first annular gap is formed between said inner tubular portion and said intermediate tubular portion;

wherein a second annular gap is formed between said intermediate tubular portion and said outer tubular portion;

at least one outer gasifying agent inlet disposed on said upstream end of said outer tubular portion for charging a gasifying agent into said second annular gap;

at least one intermediate gasifying agent inlet disposed on said upstream end of said intermediate tubular portion for charging a gasifying agent into said first annular gap;

at least one intermediate fuel inlet disposed on said upstream end of said intermediate tubular portion for charging fuel into said first annular gap;

at least one inner gasifying agent inlet disposed on said upstream end of said inner tubular portion for charging a gasifying agent into said inner tubular portion;

at least one inner fuel inlet disposed on said upstream end of said inner tubular portion for charging fuel into said inner tubular portion;

wherein at least one inlet from the group consisting of said at least one outer gasifying agent inlet, said at least one intermediate gasifying agent inlet, said at least one intermediate fuel inlet, said at least one inner gasifying agent inlet, and said at least one inner fuel inlet is positioned in a direction that is tangent to a circle around said central axis, said circle being located in a plane perpendicular to said central axis;

a seal gas tube positioned within said inner tubular portion, said seal gas tube having an upstream end and a downstream end; and a starting burner tube positioned within said seal gas tube, said starting burner tube having an upstream end and a downstream end.

2. The burner of claim 1, further comprising a swirler on said downstream end of said outer tubular portion, said swirler being located within said second annular gap.

3. The burner of claim 2, further comprising a gasifying agent having oxygen, and a fuel, wherein said gasifying agent and said fuel are charged in said triple tubular member such that a mixture is formed having an oxygen weight to fuel weight ratio of 0.19 to 0.46.

4. The burner of claim 2, further comprising a flame holding block on said downstream end of said outer tubular portion, said flame holding block being located within said second annular gap.

5. The burner of claim 4, further comprising a gasifying agent having oxygen, and a fuel, wherein said gasifying agent and said fuel are charged in said triple tubular member such that a mixture is formed having an oxygen weight to fuel weight ratio of 0.19 to 0.46.

6. The burner of claim 1, further comprising a gasifying agent having oxygen, and a fuel, wherein said gasifying agent and said fuel are charged in said triple tubular member such that a mixture is formed having an oxygen weight to fuel weight ratio of 0.19 to 0.46.

7. The burner of claim 1, further comprising a flame holding block on said downstream end of said outer tubular portion, said flame holding block being located within said second annular gap.

8. The burner of claim 1, wherein said inner tubular portion has an inner diameter, said inner tubular portion having a length that is at least 5 times greater than said inner diameter of said inner tubular portion.

9. The burner of claim 1, wherein said downstream end of said inner tubular portion, said downstream end of said intermediate tubular portion, and said downstream end of said outer tubular portion are axially coterminous at said downstream end of said triple tubular member.

10. The burner of claim 1, further comprising a seal gas inlet disposed on said upstream end of said seal gas tube for charging a seal gas into said seal gas tube, wherein said seal gas insulates said inner tubular portion from said starting burner tube.

11. The burner of claim 1, wherein said at least one intermediate gasifying agent inlet and said at least one intermediate fuel inlet are disposed on said upstream end of said intermediate tubular portion such that the gasifying agent and the fuel impinge upon each other at an upstream end of said first annular gap.

12. The burner of claim 11, wherein said at least one inner gasifying agent inlet and said at least one inner fuel inlet are disposed on said upstream end of said inner tubular portion such that the gasifying agent and the fuel impinge upon each other at said upstream end of said inner tubular portion.

13. The burner of claim 1, wherein said at least one inner gasifying agent inlet and said at least one inner fuel inlet are disposed on said upstream end of said inner tubular portion such that the gasifying agent and the fuel impinge upon each other at said upstream end of said inner tubular portion.

* * * * *